US006328558B1

(12) United States Patent
Dover et al.

(10) Patent No.: US 6,328,558 B1
(45) Date of Patent: Dec. 11, 2001

(54) PURGE CHAMBER

(75) Inventors: Bruce J. Dover; Carl Vander Weide, both of Lockport; Edward V. McCormick, Churchville, all of NY (US)

(73) Assignee: Harper International Corp., Lancaster, NY (US)

( * ) Notice: Subject to any disclaimer, the term of this patent is extended or adjusted under 35 U.S.C. 154(b) by 0 days.

(21) Appl. No.: 09/632,880

(22) Filed: Aug. 4, 2000

(51) Int. Cl.[7] ..... F27B 5/04; F24F 9/00

(52) U.S. Cl. ..... 432/152; 432/64; 432/128; 432/205

(58) Field of Search ..... 432/64, 121, 128, 432/152, 189, 205, 247, 251; 266/176, 177

(56) References Cited

U.S. PATENT DOCUMENTS 3,778,221 * 12/1973 Bloom ..... 432/128
4,238,122 * 12/1980 Synder et al. ..... 432/23
4,397,451 * 8/1983 Kinoshita et al. ..... 432/128
4,627,814 * 12/1986 Hattori et al. ..... 432/128
6,074,202 * 6/2000 Yagi et al. ..... 432/205

* cited by examiner

*Primary Examiner*—Gregory Wilson
(74) *Attorney, Agent, or Firm*—Arthur S. Cookfair

(57) ABSTRACT

A purge chamber for providing a controlled atmosphere for the treatment of materials comprises a housing within which materials to be treated may be passed through and subjected to a cross-flow of purging gas entering and exiting through a multiplicity of inlets and outlets positioned along the length of the housing. Exiting gas may be recycled and re-entered in combination with fresh gas. In practice, materials to be treated may be conveyed through the chamber while the atmosphere surrounding the materials is continuously exchanged. Flapper doors, spanning the width of the chamber, are positioned along the path of travel of the materials being treated to direct the cross-flow of purging gas and prevent the entry of unwanted gases.

17 Claims, 2 Drawing Sheets

PURGE CHAMBER

BACKGROUND OF THE INVENTION

1. Field of the Invention

This invention relates to a method and apparatus for the control and exchange of the atmosphere surrounding materials to be treated.

2. Background and Prior Art

In the thermal processing of materials, especially various electronic components, by treatment with various reactive gases in high temperature furnaces, it is often necessary to purge the materials and their environment of gases, such as air, that may produce adverse reactions in the high temperature conditions of the furnace. To this end, various exhaust systems, scavenger chambers, and the like, have been designed for the purging of the materials prior to entry into the furnace or within the furnace, generally near the entry section of the furnace.

U.S. Pat. No. 4,992,044 to Phillipossian discloses a furnace for high temperature treatment of semiconductor wafers utilizing a scavenger arrangement for controlling gas flow.

U.S. Pat. No. 5,118,286 to Sarin discloses a method and apparatus for controlling gas flow patterns and avoiding the mixing of spent reactant gases with ambient air in the treatment of semiconductor wafers.

U.S. Pat. No. 5,645,417 to Smith discloses a thermal treatment of silicon wafers in a thermal processing furnace tube wherein the inner surface has a plurality of dimples thereon to promote a more turbulent flow of gases and a more uniform reaction across the surface of the wafers.

SUMMARY OF THE INVENTION

It is an object of the present invention to provide a chamber for containing a material to be treated that may be efficiently purged and the contained atmosphere exchanged and replaced by a selected atmosphere.

It is a further object to provide a purge chamber for controlling the atmospheric environment of materials to be subject to thermal processing.

It is a still further object to provide a purge chamber for the gaseous treatment of materials that may be operated as a stationary independent unit or in a cooperative arrangement with a unit for thermal processing.

It is a still further object to provide an open ended purge chamber for the gaseous treatment of a continuously moving product stream, prior to entry into kiln for thermal treatment.

It is a still further object to provide a purge chamber for the gaseous treatment of materials wherein the gases may be recycled.

It is a still further object to provide a purge chamber adapted for attachment to a furnace for the gaseous treatment of a moving product stream, prior to entry into or exit from a furnace for thermal treatment.

The above and other objects are achieved in accordance with the present invention, which comprises a purge chamber for providing a controlled gaseous atmosphere for the treatment of materials. The purge chamber comprises a housing having an entrance end and an exit end, means for conveying materials therethrough, gas inlets and outlets, and internal gas barriers to provide a controlled flow of gases within the housing. Within the housing, a first gas barrier and a second gas barrier may be positioned respectively near the entrance end and the exit end to inhibit the entry of unwanted gases and to define a purge region having a controlled flow of gases therethrough. The gas barriers are flexible physical barriers, preferably extending across the full width of the purge chamber and suspended from the upper portion of thereof. The gas barriers are flexible to allow the passage of material being conveyed through the chamber. Preferably, the gas barriers are in the form of flapper doors, spanning the width of the chamber and hingedly suspended from a supporting rack near the top of the purge chamber. As materials being conveyed through the chamber contact a flapper door, the door may be pushed up by the moving materials allowing the materials to pass. Alternatively, the gas barriers may be in the form of flexible strips, for example, plastic strips, or chains, or thin strips of metal foil, or the like. The strips may be arranged in multiple staggered rows and suspended from the upper region of the chamber, and sufficiently flexible to be pushed aside by the materials passing through and able to return to their original vertical orientation after the materials have passed. The gas barrier at the entry end and the exit end of the purge region aid in the maintenance of a slight positive pressure therein. Optionally, additional gas barriers may be present to further control the flow of purge gases and define additional purge regions within the purge chamber. In a preferred embodiment, the gas barriers, that is, flapper doors, flexible strips, or the like, are suspended from a removable frame mounted at the top of the purge chamber, so that the number and location of the doors, or gas barriers , can be conveniently modified to adjust to various process requirements. The frame may be supported on tracks or on hangers located in the upper portion of the interior of the purge chamber.

Positioned within the purge region, that is between the first and second gas barriers, are at least one purge gas inlet and at least one purge gas outlet to provide a cross-flow of selected gases to purge and replace the gases within the purge region. Additionally, positive pressure gas inlets are preferably positioned adjacent to the first and second gas barriers to provide a positive pressure at each end and act as a barrier to entry of unwanted gases from outside of the purge region.

The purge chamber of this invention may be operated as a batch unit for the gaseous treatment of materials. However, in a preferred mode, the purge chamber is provided with a means for conveying materials being treated through the chamber in a continuous fashion. Various conveyors or transport systems such as rollers, tracks, moving belts, and the like may be used for this purpose. One such transport system that may be employed is disclosed in U.S. Pat. No. 5,848,890 to McCormick. As a load of materials are conveyed through the chamber, the hinged flapper doors are pushed open by the moving load, allowing it to pass through.

The purge chamber may be of various sizes and shapes, the preferred shape being of rectangular cross-section with a height substantially less than the width, to enhance the cross-flow of gas. The length may vary considerably. In general, the longer the chamber, the more complete the gas purging that will take place.

The purge chamber may be operated as a "stand alone" unit for the gaseous treatment of materials or as an appendage or attachment unit for a furnace or other apparatus. For the latter purpose it is preferred that the entrance end and the exit end have means such as flanges for attachment to a furnace either at the entrance of the furnace, for a pretreatment of the materials to be processed or at the exit end of the furnace for a post-treatment, or both. When the chamber is attached to a furnace, the transport means, e.g. moving belt, etc. may be cooperatively connected to transport mechanism within the furnace for continuous transport of the materials through the chamber and through the furnace.

The purge chamber may be operated at various temperatures. The operating temperature will typically be between about room temperature and about 200° C. Various materials of construction may be employed, including for example, steel, graphite, plastic or the like, depending on the temperature and other process conditions to be applied.

BRIEF DESCRIPTION OF THE DRAWINGS

The present invention and the manner in which it may be practice are further illustrated by the accompanying drawings wherein.

DETAILED DESCRIPTION OF THE INVENTION

Figure 1:
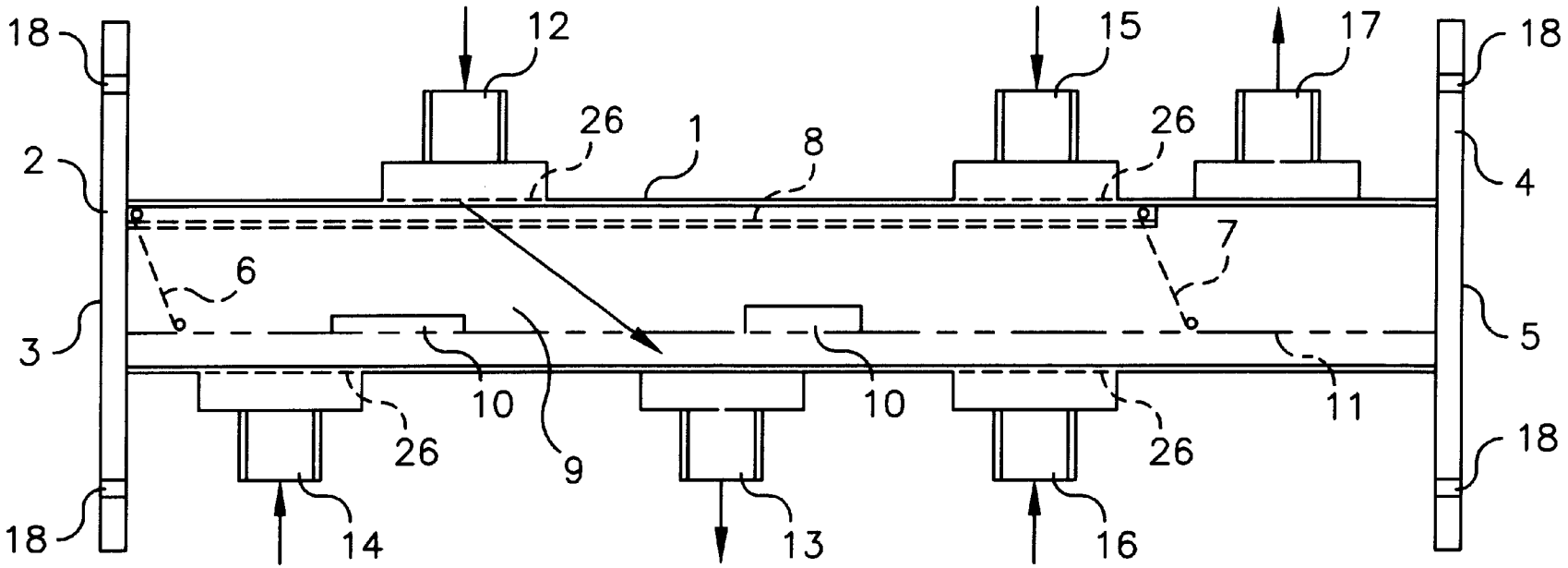
FIG. 1 is a side cross-sectional view of a purge chamber in accordance with the invention.

The purge chamber of the present invention, as illustrated in FIG. 1, includes a housing 1 having a flange 2 at entry end 3 and flange 4 at exit end 5. Within the chamber, flapper door 6, near entry end 3, and flapper door 7, near exit end 5 are hingedly suspended from supporting rack 8. The flapper doors define a purge region 9 wherein the gaseous environment is controlled. As the material load 10 is conveyed through the chamber transport means, such as wire belt, 11, a cross-flow of purge gas may enter through inlet 12 and exit through outlet 13. In addition, a positive pressure inlet 14, provides a positive pressure in the region near entry 3 to inhibit the entry of unwanted air or other gases. The gas entering through inlet 14 may exit through outlet 13 and through flapper door 6 and entry 3. Inlet 15 and inlet 16 provide for the entry of gases to create a positive pressure near the exit end 5 to inhibit the entry of unwanted gases through the exit end 5. Gases entering through inlets 15 and 16 may exit primarily through outlet 17 as well as exit 5 and will serve to create a positive pressure within the purge region 9 at flapper door 7. When the purge chamber is attached to the entrance of a furnace (FIG. 2), outlet 17 will further serve to exhaust any unwanted gases that may enter through exit 5 from the furnace.

To effect an even distribution of gases entering the purge chamber, the inlets, such as inlets 12, 14, 15, and 16 may be provided with inner surfaces having multiple rows of precision cut slots 26 through which entering gases are passed to evenly distribute the gas across the chamber and sized to increase flow velocities to improve purging efficiencies. Slots 26 may be arranged in various patterns or configurations such as staggered parallel rows or in an angled herringbone configuration and may be positioned within the gas inlet or as a part of purge chamber housing.

The purge chamber of this invention may be operated independently as a chamber for the gaseous treatment of material, or may be operated cooperatively with a furnace or other unit for further treatment of the materials. It may, for example, be attached to the entrance of a kiln or furnace for pretreatment of materials to be further heat treated, or at the exit of such a furnace or kiln for a gaseous post treatment of materials that have been passed through the kiln or furnace in such case, conveyor means 11 may be continuous within the purge chamber(s) and the furnace. Various attachment means may be used, including flanges, such as flanges 2 and 4 by means of bolts through bolt holes 18. In some instances, a furnace treatment may involve treatment with gases that might tend to expand into the purge chamber through exit end 5 and contaminate the atmosphere within the purge chamber. Such gases may be exhausted through exhaust outlet 17.

Figure 2:
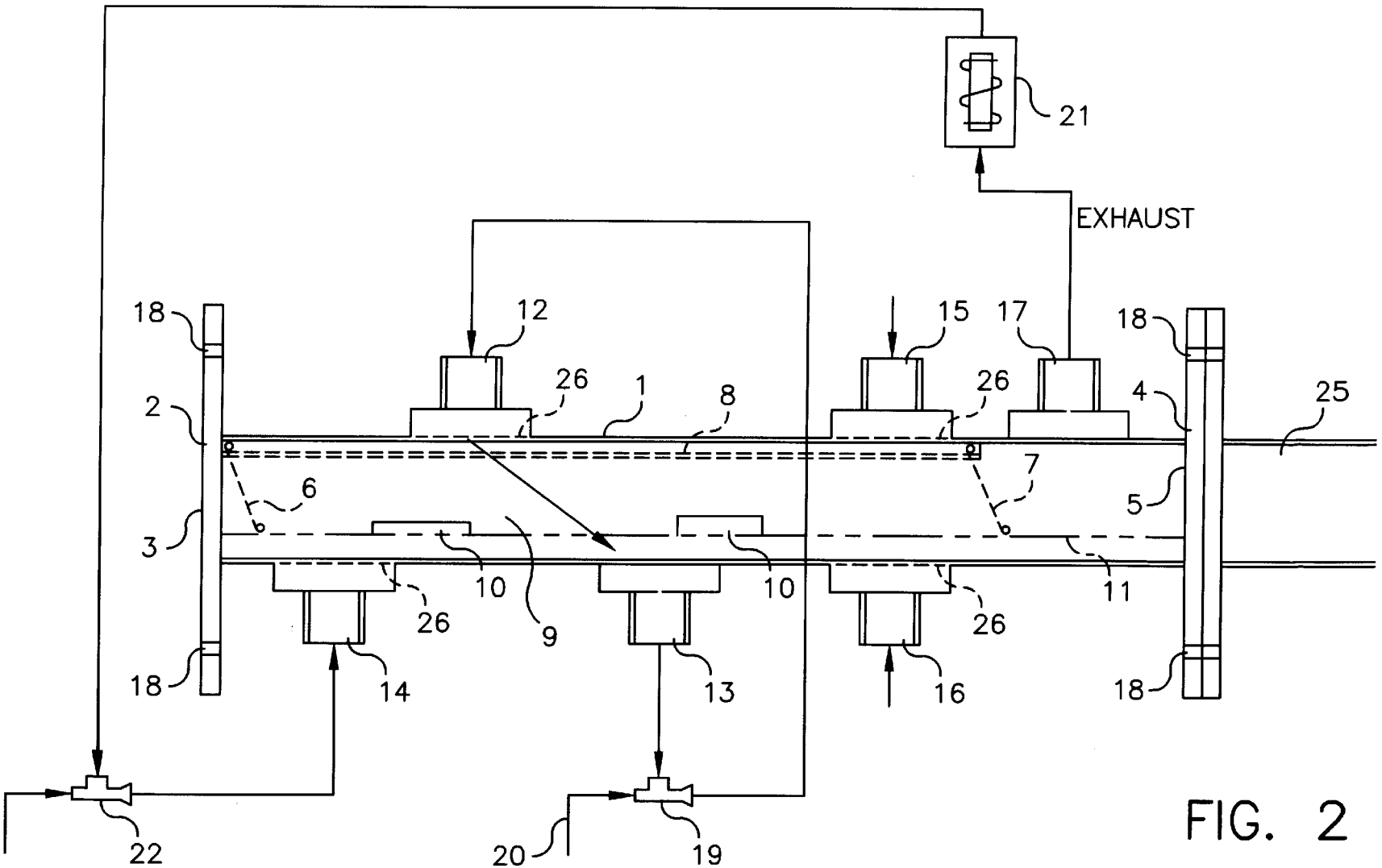
FIG. 2 is a side cross-sectional view of a preferred embodiment of a purge chamber in accordance with the invention attached at the entrance end of a furnace.

In a preferred embodiment, as depicted in FIG. 2, the purge chamber of the present invention may include means for recycling the gases employed in the purge chamber treatment as well as gases from an attached furnace. Thus, for example, purge gases entering the chamber through inlet 12 through line 20 may be first be routed through eductor 19 to combine with all or a portion of the gases exiting from outlet 13. Exiting gases may be treated if necessary before being recycled. For example, if the gaseous treatment in the purge chamber is used to remove moisture from the atmosphere, the exiting gases may be dried by passing through a condenser, or other moisture removing treatment before being recycled to the purge chamber. Furthermore, gases entering from an attached furnace, such as furnace 25 may be similarly and recycled into the purge chamber. As an example, furnace treatment of some electronic components may require heating in a humidified atmosphere and a portion of the humidified gas from attached furnace 25 may enter the purge chamber through exit 5. In the embodiment illustrated in FIG. 2, such humidified gases may be exhausted through outlet 17 and passed through condenser 21 before being recycled through eductor 22 to inlet 14.

Although the invention has been described with reference to certain preferred embodiments, it will be appreciated by those skilled in the art that modifications and variations may be made without departing from the spirit and scope of the invention as defined by the appended claims.

What is claimed is:

1. A purge chamber for the gaseous treatment of materials comprising:

A) a housing having an entrance end and an exit end;

B) a first flexible gas barrier to inhibit the entry of unwanted external gases at said entrance end and a second flexible gas barrier to inhibit the entry of unwanted external gases at said exit end, said first and second flexible gas barriers defining a purge region within said housing;

C) at least one purge gas inlet and at least one purge gas outlet positioned within said purge region to provide a cross-flow of purge gases to purge and replace the gases within said purge region of said housing;

D) at least one first positive pressure gas inlet within said purge region adjacent said first flexible gas barrier to inhibit the entry of unwanted external gases into said purge region at said entrance end and at least one second positive pressure gas inlet within said purge region adjacent said second flexible gas barrier to inhibit the entry of unwanted external gases into said purge region at said exit end.

2. A purge chamber according to claim 1 having means for conveying materials to be treated through said purge chamber from said entrance end to said exit end.

3. A purge chamber according to claim 1 having a flange at said exit end for attachment to a furnace.

4. A purge chamber according to claim 1 having a flange at said entrance end for attachment to a furnace.

5. A purge chamber according to claim 1 wherein said first flexible gas barrier and said second flexible gas barrier are each a flapper door hingedly suspended from an upper supporting rack.

6. A purge chamber according to claim 1 having means for recycling at least a portion of said purge gases.

7. A purge chamber for the gaseous treatment of materials comprising:

A) a housing having an entrance end and an exit end;

B) a first flexible gas barrier to inhibit the entry of unwanted external gases at said entrance end and a second flexible gas barrier to inhibit the entry of unwanted external gases at said exit end, said first and second flexible gas barriers defining a purge region within said housing;

C) at least one purge gas inlet and at least one purge gas outlet positioned within said purge region to provide a cross-flow of purge gases to purge and replace the gases within said purge region of said housing;

D) at least one first positive pressure gas inlet within said surge region adjacent said first flexible gas barrier to inhibit the entry of unwanted external gases into said purge region at said entrance end and at least one second positive pressure gas inlet within said purge region adjacent said second flexible gas barrier to inhibit the entry of unwanted external gases into said purge region at said exit end;

E) an exhaust outlet adjacent said exit end for the removal of gases.

8. A purge chamber according to claim 7 attached at said exit end to the entrance end of a furnace for the further treatment of said materials.

9. A purge chamber according to claim 8 wherein said exhaust outlet is connected to a recycling means for exhaust gases.

10. A purge chamber according to claim 9 wherein said recycling means includes a condenser for the removal of moisture from said exhaust gases.

11. A purge chamber for the gaseous treatment of materials comprising:

A) a housing having a length with an entrance end and an exit end and a width and a height, said width being greater than said height;

B) a first flapper door to inhibit the entry of external gases at said entrance end and a second flapper door to inhibit the entry of gases at said exit end, said first and second flapper doors being hingedly suspended from an upper supporting rack and defining a purge region within said housing;

C) at least one purge gas inlet and at least one purge gas outlet positioned within said purge region on opposite sides of said housing to provide a cross-flow of purge gas to purge and replace gases within said purge region;

D) at least one first positive pressure gas inlet within said purge region adjacent said first flapper door to inhibit the entry of unwanted external gases and at least one second positive pressure inlet within said purge region adjacent said second flapper door to inhibit the entry of unwanted external gases;

E) means for conveying said materials to be treated through said purge chamber from said entrance end to said exit end;

F) a flange on said housing at said exit end.

12. A purge chamber for the gaseous treatment of materials comprising:

A) a housing having a length with an entrance end and an exit end and a width and a height, said width being greater than said height;

B) a first flapper door to inhibit the entry of external gases at said entrance end and a second flapper door to inhibit the entry of gases at said exit end, said first and second flapper doors being hingedly suspended from an upper supporting rack and defining a purge region within said housing;

C) at least one purge gas inlet and at least one purge gas outlet positioned within said purge region on opposite sides of said housing to provide a cross-flow of purge gas to purge and replace gases within said purge region;

D) at least one first positive pressure gas inlet within said purge region adjacent said first flapper door to inhibit the entry of unwanted external gases and at least two opposing second positive pressure inlets within said purge region adjacent said second flapper door to inhibit the entry of unwanted external gases;

E) means for conveying said materials to be treated through said purge chamber from said entrance end to said exit end;

F) a flange on said housing at said exit end.

13. A purge chamber according to claim 12 having an exhaust outlet positioned between said second flapper door and said exit end.

14. A purge chamber according to claim 13 having means for recycling at least a portion of said purge gases from at least one purge gas outlet.

15. A purge chamber according to claim 14 wherein said exhaust outlet is connected to a recycling means for gases.

16. A purge chamber according to claim 15 wherein said recycling means includes a condenser for the removal of moisture.

17. In combination, a purge chamber according to claim 16 and a furnace for the treatment of materials, said purge chamber being connected at the exit end thereof to the entrance end of said furnace.

* * * * *